US007882791B2

(12) United States Patent
Huntt

(10) Patent No.: US 7,882,791 B2
(45) Date of Patent: Feb. 8, 2011

(54) STEERING SYSTEM AND METHOD FOR A MOTOR DRIVEN CRAFT

(76) Inventor: Robert Huntt, 10420 Watkins Rd., Germantown, MD (US) 20876

( * ) Notice: Subject to any disclaimer, the term of this patent is extended or adjusted under 35 U.S.C. 154(b) by 515 days.

(21) Appl. No.: 11/979,072

(22) Filed: Oct. 30, 2007

(65) Prior Publication Data

US 2009/0107382 A1 Apr. 30, 2009

(51) Int. Cl.
*B63H 25/04* (2006.01)

(52) U.S. Cl. ..... 114/144 R; 440/6; 440/7

(58) Field of Classification Search ..... 440/6, 440/7, 58–60; 114/144 R, 144 RE
See application file for complete search history.

(56) References Cited

U.S. PATENT DOCUMENTS 2,583,059 A * 1/1952 Neville ..... 114/144 R
2,804,838 A 9/1957 Moser
2,877,733 A 3/1959 Harris
3,467,798 A 9/1969 Krieger
3,598,947 A 8/1971 Osborn
4,614,900 A 9/1986 Young
4,669,987 A * 6/1987 Schulte ..... 440/6
4,854,902 A * 8/1989 Havins ..... 440/7
5,171,174 A 12/1992 Mynster
5,465,633 A 11/1995 Bernloehr
6,325,685 B1 12/2001 Knight et al.
6,468,117 B1 10/2002 Healey
6,758,705 B1 7/2004 Bechtek et al.

* cited by examiner

*Primary Examiner*—Ed Swinehart
(74) *Attorney, Agent, or Firm*—Clark & Brody

(57) ABSTRACT

A steering system for craft turns a motor from a fixed position to a secondary position. As a result, the craft turns right or left as desired by a user of the craft. A control unit instructs the steering system to turn the craft to a desired orientation. A steering motor is activated that turns a cam attached to a shaft. The shaft is attached to the motor. The cam also includes an indent and sensors to indicate when the motor is in the fixed position or a secondary position that corresponds to a maximum angle for turning the motor. The steering system returns the motor back to the fixed position when the user indicates the steering system is to stop turning, or when the secondary position is reached. The steering system returns the motor back to the fixed position without knowledge of the user. Thus, the motor stays in one of three positions unless instructed by the control unit to turn.

8 Claims, 6 Drawing Sheets

A
B
C
C
100
206
202
109
A
C
100
B
206
202
109
118

A
B
C
100
202
206
109
118

STEERING SYSTEM AND METHOD FOR A MOTOR DRIVEN CRAFT

FIELD OF THE INVENTION

The present invention relates to orienting a motor on a craft. More particularly, the present invention relates to a steering system and method for positioning the orientation of the craft that uses a secondary motor to guide the craft.

DISCUSSION OF THE RELATED ART

Vehicles and crafts may use two separate motors to move according to certain speeds and in a certain direction. The two motors may act as a primary motor and a secondary motor. The primary motor may propel the craft at a higher speed than the secondary motor, or the secondary motor may orient the craft when the primary motor is off or at a low setting. Boats used for fishing and navigating waterways are examples of the two motor configurations. The primary motor may be the power motor and the secondary motor may be a trolling motor. Both motors may be referred to as propulsion motors.

An operator uses a trolling motor to navigate a boat, such as a fishing boat. Trolling motors may be taken out of the water when the power motor is used, and then lowered into the water to guide the boat at slower speeds and with varying orientations. A trolling motor allows the operator to propel the boat at a speed best suited for fishing without the noise or fuel associated with the power motor. Using the trolling motor, the operator can move around narrow, shallow channels and to move the boat to better fishing areas. A trolling motor, however, also may be used in deep waters, such as the ocean.

To move in a desired direction, the position of the trolling motor is changed to turn the boat right or left, or forward and reverse. The operator can use many different configurations to enable steering, such as remote control, foot pad, manually and the like. In addition, the operator may use poles to maneuver the boat in and out of tight spots. Although these actions are effective, room exists for error or mistakes in moving the boat. The operator has to relate the position of the boat to the position of the trolling motor at all times. Further, the operator may never be sure what position the trolling motor is in, and may have to go back and reset the position of the trolling motor, or try to adjust the trolling motor back to its original position. The operator has to guess whether the trolling motor is in its proper position or still at an angle.

SUMMARY OF THE INVENTION

The disclosed embodiments of the present invention provide a two motor configuration that provides improved steering control and reduces uncertainty regarding the position of the secondary motor. The two motors propel the craft, such as a boat, at differing speeds. The disclosed embodiments pertain to those instances where a secondary motor changes the orientation of the craft during operations at low speed.

Preferably, the disclosed embodiments relate to boats and water craft that use a power motor and a trolling motor to propel, navigate and guide the boat. The trolling motor preferably is attached to the back of the boat. Alternatively, the trolling motor may be located in front of the craft. The trolling motor helps turn or orient that boat as desired. A steering motor adjusts the position of the trolling motor to a specified angle in order to turn the boat. The specified angle may be between 15 degrees and 90 degrees, with a preferred angle of 45 degrees.

A user operates a control to position the trolling motor. In a fixed, or linear, position, the position of the trolling motor is straight. The orientation of the trolling motor in this position corresponds to an axis for forward and backward motion of the boat. No power is provided to the steering motor configured to position the trolling motor. Using a directional control, the user, or operator, indicates that the boat is to turn left or right by repositioning the trolling motor to an angle from the forward axis.

When the user wants to turn the craft, the control sends a command to the steering system. The steering system repositions the trolling motor. The steering system returns the trolling motor back to the fixed, or linear, position. Thus, the orientation of the trolling motor may be known without user knowledge because the trolling motor does not stay at right or left position once the operator ceases to use the control. The steering system positions itself back to the fixed position.

Preferably, a cam is part of the steering system. The cam moves to a desired position corresponding to the specified angle for positioning the trolling motor. Switches activate to rotate the steering system and the trolling motor according to the control. Sensors also may be used to control positioning of the cam along with rollers that fall into an indentation that acts as a limit on the rotation angle. The cam can move clockwise or counterclockwise.

According to the disclosed embodiments, a method for orienting of a craft is disclosed. The method includes propelling the craft in a forward or backward orientation using a trolling motor and a steering motor in a fixed position. The method also includes repositioning the steering motor towards a desired orientation of the craft by turning the trolling motor away from the fixed position. The method also includes returning the trolling motor to the fixed position when the steering motor stops turning the trolling motor.

Further according to the disclosed embodiments, a method for positioning a craft using a motor is disclosed. The method includes turning the motor from a fixed position to a secondary fixed position using a steering system operatively connected to the motor. The method also includes returning the motor to the fixed position upon disengagement of the steering system or reaching the secondary position without instruction from a user.

Further according to the disclosed embodiments, a steering system for a craft having a motor is disclosed. The steering system includes a steering motor to rotate a shaft attached to the motor from a fixed position towards a secondary position. The secondary position corresponds to a right or left turn. The steering system also includes a cam surrounding the shaft to engage the steering motor. The steering system also includes means for positioning the motor back to the fixed position upon the motor reaching the secondary position or the steering motor ceasing rotation of the shaft.

Further according to the disclosed embodiments, a steering system is disclosed. The steering system includes a steering motor. The steering system also includes a cam to engage the steering motor that turns in response to the steering motor. The steering system also includes a shaft attached to a propulsion motor and to the cam. The shaft turns the motor as the cam turns. The steering system also includes means to indicate a fixed position and a secondary position for the motor. The means determines the fixed and secondary positions using the cam as it turns. The steering motor returns the motor back to the fixed means when the means to indicate determines the motor reached the secondary position or upon an instruction to stop turning.

BRIEF DESCRIPTION OF THE DRAWINGS

The accompanying drawings are included to provide further understanding of the invention and constitute a part of the specification. The drawings listed below illustrate embodiments of the invention and, together with the description, serve to explain the principles of the invention, as disclosed in the claims.

DETAILED DESCRIPTION OF THE PREFERRED EMBODIMENTS

Reference will now be made in detail to the preferred embodiments of the present invention. Examples of the preferred embodiments are illustrated in the accompanying drawings.

Figure 1:
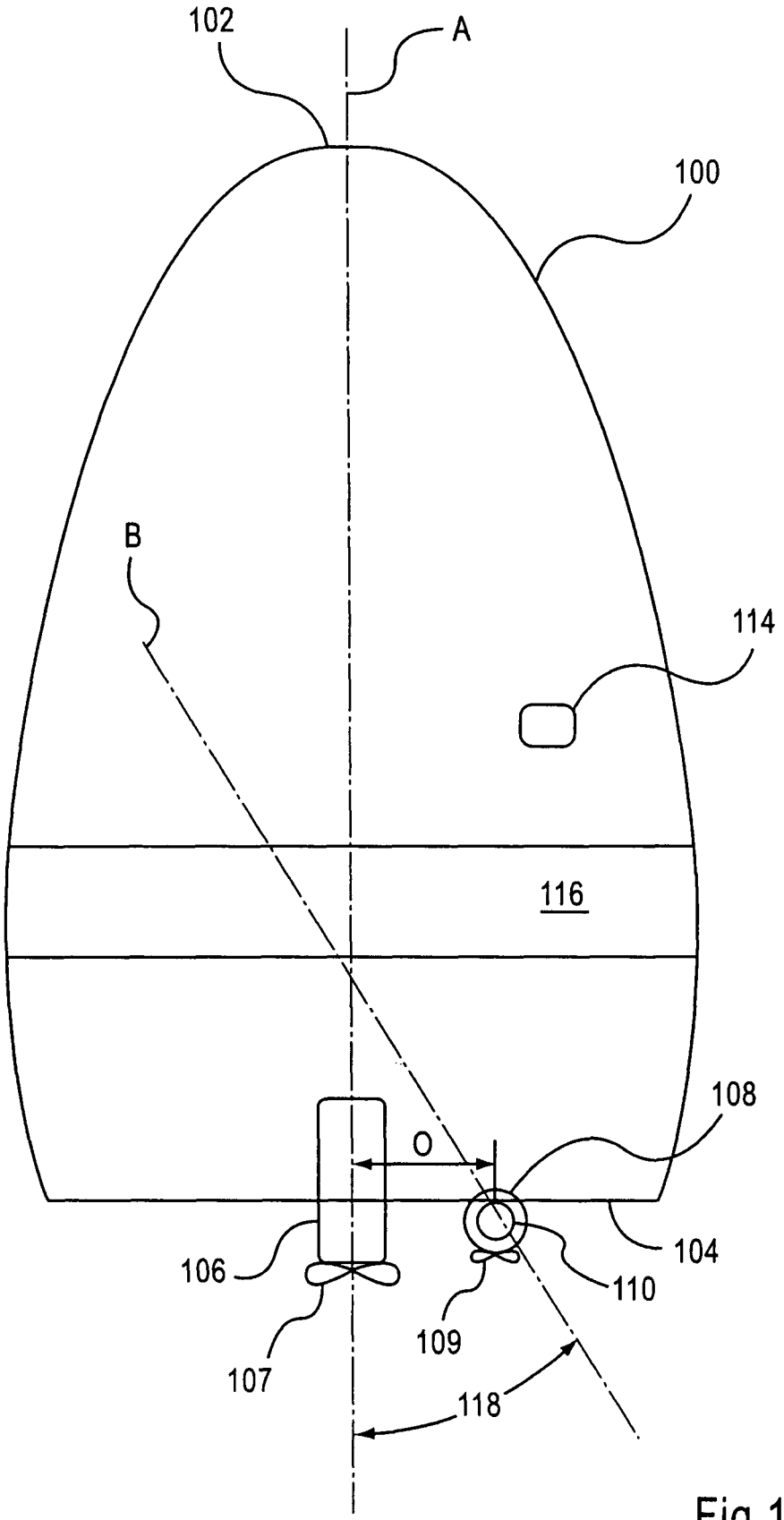
FIG. 1 illustrates a craft having a steering system according to the disclosed embodiments.

FIG. 1 depicts a craft 100 having a steering system according to the disclosed embodiments. Preferably, craft 100 is a boat that includes motors placed in its rear, or stern, which move craft 100 forward. Craft 100, however, is not limited to use on boats or sea-going vessels, but may be used by any craft using a motor to propel the craft forward. More preferably, craft 100 is a boat used for navigating water. For reference purposes, craft 100 includes front, or bow, 102 and rear 104.

Craft 100 includes various features that may be found on a boat. For example, craft 100 includes a power motor 106 with propeller 107 and a trolling motor 108 with propeller 109. Craft 100 also includes a board, or seat, 116. Board 116 is shown here merely as a reference and craft 100 is not limited to the position shown in FIG. 1 or to not having other boards, seats, planks, elevated structures, and the like. Steering system 110 is attached to trolling motor 108.

A user, or operator, of craft 100 uses a control 114 to guide and move in desired directions. Control 114 sends commands or instructions to power motor 106, trolling motor 108 and steering system 110. Control 114 may be a remote control device, a footpad control that is activated using the foot of the operator or any other steering control known in the art. Preferably, control 114 resides on the bottom of craft 100 so that the operator stands on a pad. Two bars with bumpers extend from the pad to interact with a knee of the operator. Using the bumpers, the user steers craft 100 by touching his knee to the appropriate bumper for the desired turn direction.

FIG. 1 also depicts directional axis A that designates a line showing the forward and backward direction of craft 100. In other words, if craft 100 moves straight forward, then directional axis A indicates the line or orientation of the direction of movement. If craft 100 reverses, then direction axis A indicates the same orientation, but with the direction going backwards. FIG. 1 also shows turn axis B that is disclosed in greater detail below.

Trolling motor 108 may be located any place on craft 100. For example, trolling motor 108 may be located at front 102 of craft 100, or right next to power motor 106 either at front 102 or back 104. Preferably, trolling motor 108 is located at an offset O from power motor 106. Offset 106 may vary depending on the size, type, shape and the like of craft 100. An operator or building may move the location of trolling motor 108 until a satisfactory offset O is determined. In addition, trolling motor 108 should be near enough to power motor to effectively move craft 100 in the direction of directional axis A.

Figure 2:
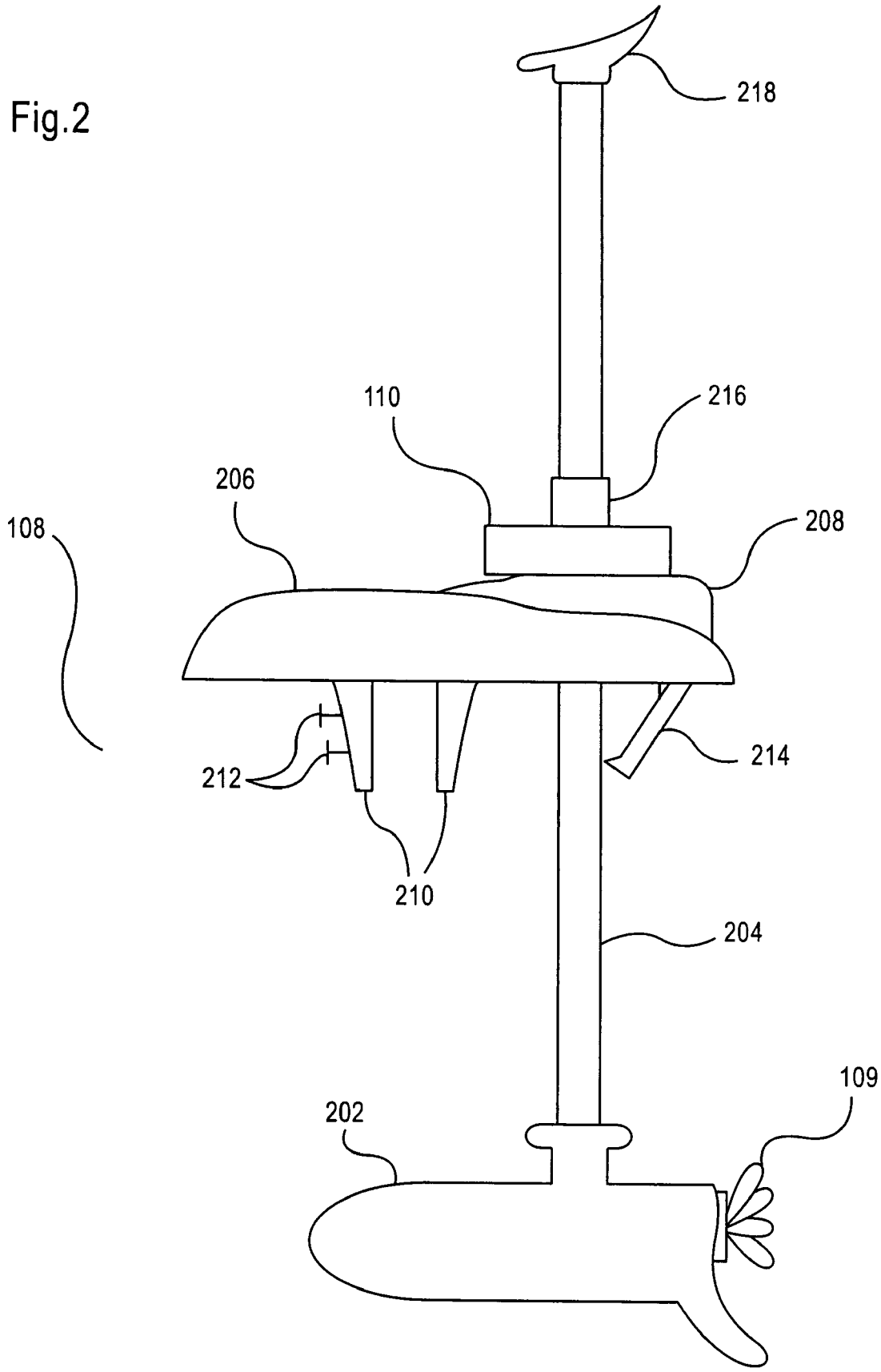
FIG. 2 illustrates a trolling motor having a steering system according to the disclosed embodiments.

Preferably, the disclosed embodiments are used while trolling motor 108 propels and guides craft 100. Trolling motor 108 is a trolling motor known in the art. The term "trolling motor" may be a recognized term in the art to indicate the drive motor for a propeller as well as other features needed to mount the trolling motor to the boat. Referring to FIG. 2, trolling motor 108 includes a small electric, or drive, motor 202 coupled to propeller 109 for quietly adjusting the position of craft 100 at relatively slow speeds to allow greater maneuvering.

Trolling motor 108 also may include housing 206 that straddles the side of craft 100. Housing 206 encloses shaft 204, which is connected to drive motor 202. Shaft 204 turns either right or left to turn drive motor 202. Shaft 204 also may be known as a steering column. Steering system 110 also is attached to shaft 204 and is held in place along by collar 216. Preferably, steering system 110 rests on mount 208 of housing 206. Alternatively, steering system 110 is enclosed within housing 206.

Trolling motor 108 also includes brackets 210 and screws 212 for mounting on the side of craft 100. Brackets 210 and screws 212 are shown for illustrative purposes only, and trolling motor 108 may use any conventional configuration to secure itself on the side of craft 100. For example, brackets 210 may be adjustable to be locked in a position so that screws 212 are not required. Screws 212 refer to any number of screws that are used with either bracket.

Position lock 214 extends from housing 206 to come into contact with shaft 204. Position lock 214 may be used to keep shaft 206 in place after trolling motor 108 is placed in a stowed position. Trolling motor 108 comes to a "locked" position while in the forward orientation to move craft 100 along axis A. Position lock 214 also may be used to keep shaft 204 from vibrating or being knocked out of position while craft 100 is in use.

Trolling motor 108 also includes receiver 218. Receiver 218 receives instructions and commands from control 114. Receiver 218 sends those instructions and commands to steering system 110 or housing 206/motor 202. Instructions and commands may instruct motor 202 to activate and come on. Steering system 110 may be asked to turn shaft 204 in a certain direction in order to change the orientation of craft 100. Receiver 218 is connected to control 114 in a manner known in the art. Preferably, control 114 sends its commands wirelessly. Receiver 218 also may be located any place on trolling motor 108.

Steering system 110 moves shaft 204 to a point set by the disclosed embodiments. Referring to FIG. 1, turn axis B indicates an angle 118 from directional axis A that shows the point to which steering system 110 turns shaft 204 for trolling motor 108. Thus, trolling motor 108 turns its orientation to align with axis B so that craft 100 turns. Receiver 218 receives instructions for control 114. Receiver 218 forwards the move instruction to housing 206 or steering system 110. Steering system 110 rotates shaft 204 to the desired angle. Craft 100 reacts according to the direction of trolling motor 110.

Angle 118 of FIG. 1 may be from 15 to 90 degrees. Preferably, angle 118 is from 30 to 60 degrees so that craft 100 may turn in a gradual manner without causing damage. More preferably, angle 118 is about 45 degrees from axis A to axis B. During a turn, receiver 218 receives the command from control 114. Receiver 218 then relays the command to housing 206 and steering motor 110. Steering motor 110 then proceeds to turn shaft 204 toward turn axis B. For example, if craft 100 is to turn right, then steering motor 110 turns shaft 204 to the left so that trolling motor 108 is facing the left side of craft 100. Thus, front 102 of craft 100 orients directional axis A towards the right.

Steering system 110 continues turning shaft 204 until angle 118 between axis A and turn axis B is reached. Once at angle 118, steering system 110 may instruct trolling motor 108 to lock shaft 204 in its position to keep motor 202 moving craft 100 to the right. Preferably, steering system 110 releases shaft 204 to return to its original, or fixed, position so that trolling motor 108 is facing towards front 102, and oriented in line with directional axis A. In this position, shaft 204 is locked so that trolling motor 108 proceeds with moving craft 100 forward. Thus, upon completion of the orientation of craft 100, trolling motor 108 is automatically returned to the fixed linear position to propel craft 100 straight ahead.

The fixed positions for trolling motor 108 improves conditions for a user of craft 100. Trolling motor 108 may be in one of three positions, either straight forward or turning at a right angle and a left angle. The user does not need to look back to see which way trolling motor 108 is pointing. In other words, the user does not need knowledge of the position of trolling motor 108. If the user is not using control 114 to turn trolling motor 108, then the user knows trolling motor 114 is moving craft 100 forward. This reduction in possible position keeps craft 100 from veering off course, accidentally running onto ground, and the like, due to user error. The user may move forward with confidence that craft 100 will not turn unless instructed.

Figures 3A, 3B, 3C:
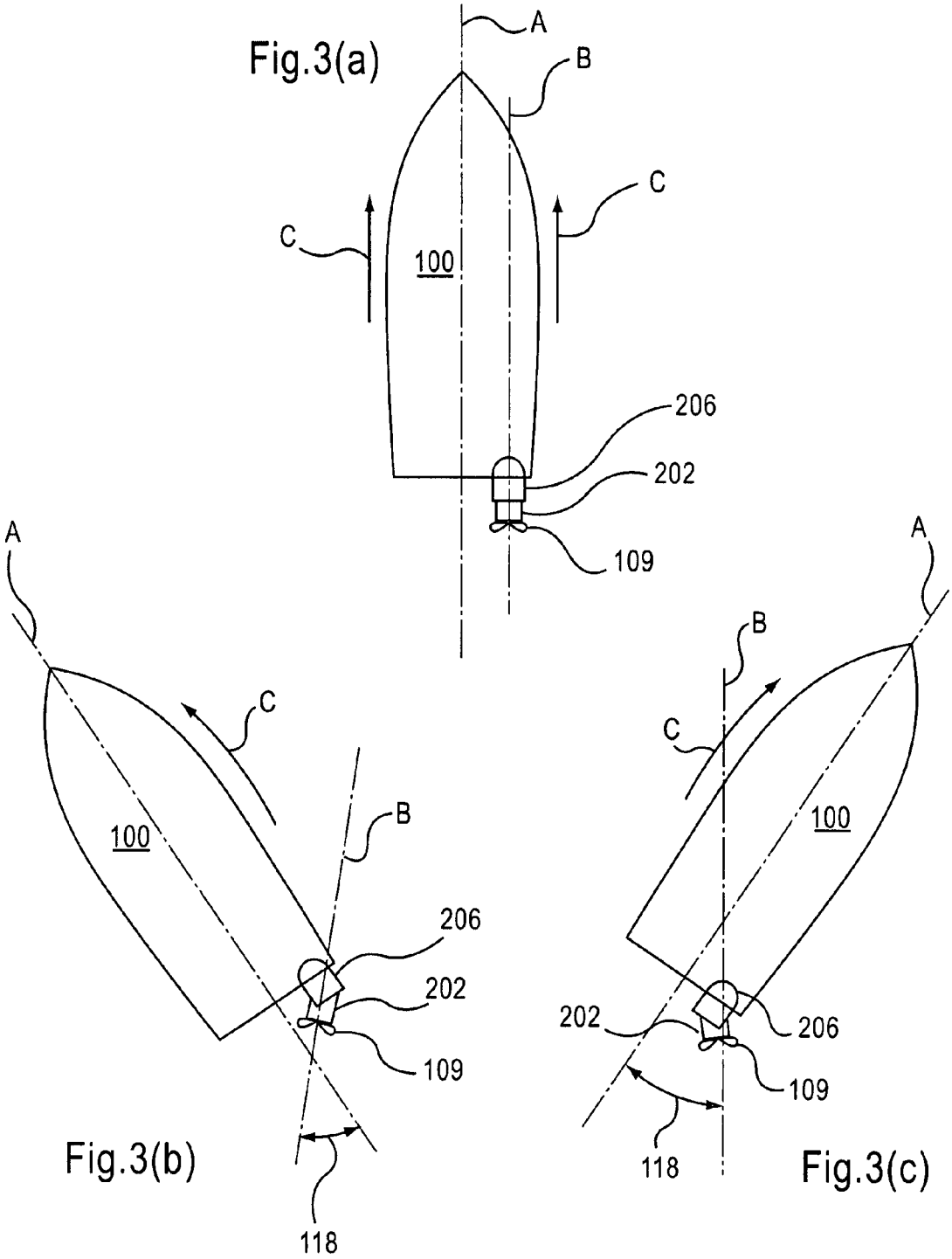
FIGS. 3(*a*)-(*c*) illustrate a straight ahead, left turn and right turn orientation of a craft and a trolling motor according to the disclosed embodiments.

FIGS. 3(*a*)-(*c*) depict straight ahead, left turn and right turn orientations of craft 100 and trolling motor 108 according to the disclosed embodiments. FIG. 3(*a*) depicts the straight ahead orientation. FIG. 3(*b*) depicts the left turn orientation. FIG. 3(*c*) depicts the right turn orientation. Craft 100 is shown moving forward in accordance with the disclosed embodiments. Craft 100 also may move backwards using trolling motor 108

FIG. 3(*a*) shows craft 100 moving forward, as indicated by directional arrows C. Directional axis A touches the front, or bow, of craft 100, and goes straight through to the back. Directional axis A does not change its position in relation to craft 100. Directional axis A may not be the exact direction that craft 100 is going because it needs an area to turn. Turn axis B is not really in effect during this orientation because craft 100 is not going to turn and a substantial angle does not exist between lines A and B. In other words, trolling motor 108, using housing 206, motor 202 and propeller 109, moves craft 100 straight ahead. Turn axis B comes into play below.

As disclosed above, this position may be known as the "fixed" position. Motor 202 of trolling motor 108 is locked into the straight ahead orientation in the fixed position. The user does not need to continually look around to see which way motor 202 is oriented. Motor 202 comes back to the fixed position if no command or instruction is being given to turn left or right. Housing 206 does not move with motor 202.

FIG. 3(*b*) depicts craft 100 turning to the left. Directional arrow C indicates that craft 100 is moving towards the left, but in a gradual manner. Directional axis A shows the forward direction of craft 100 should trolling motor 208 return back to the fixed position after completing the turn.

Unlike FIG. 3(*a*), FIG. 3(*b*) shows turn axis B intersecting directional axis A to create angle 118. Motor 202 turns propeller 109 to the right so that propeller 109 is in line with the intersection of axis A and axis B. As propeller 109 spins, the rear of craft 100 is moved so that the front is moving in the direction shown by directional arrow C.

As disclosed above, the preferred value of angle 118 is about 45 degrees. Other values for angle 118 also are acceptable, such as 30 degrees or 60 degrees. Motor 202 may move gradually so that angle 118 reaches a specified position, such as 45 degrees. Upon reaching this position, motor 202 may automatically move back to the fixed position wherein axis A and axis B do not intersect. Alternatively, the operator may indicate that motor 202 is to stay in position to keep angle 118 between axis A and axis B so that craft 100 continues to move in the direction shown by directional arrow C.

FIG. 3 (*c*) depicts craft 100 turning to the right. Directional arrow C indicates that craft 100 is moving gradually towards the right. Like in FIG. 3(*b*), directional axis A shows the forward direction of craft 100 should trolling motor 108 return back to the fixed position after completing the turn. FIG. 3(*c*) also shows turn axis B intersecting directional axis A to create angle 118. Motor 202 turns propeller 109 to the left so that propeller 109 is in line with the intersection of axis A and axis B. As propeller 109 spins, the rear of craft 100 is moved so that the front is moving in the direction shown by directional arrow C.

Motor 202 may return back to the fixed position as disclosed above with regard to FIG. 3(*b*). Alternatively, the user may indicate craft 100 is to turn a bit to the left after turning right. Thus, motor 202 swings propeller 109 around to move through the fixed position to turn craft 100 left, or the user may indicate no more turning is to be made and release control of trolling motor 108 and steering system 110. Motor 202 then returns to the fixed position.

Thus, craft 100 can be controlled by using steering system 110 to turn motor 202 so that propeller 109 moves turn axis B to intersect with directional axis A and to create angle 118. The greater the value for angle 118, the sharper the turn for craft 100. Angle 118 preferably is set to a specified value, such as 45 degrees.

Upon reaching the specified value, steering system 110 stops turning motor 202. Motor 202, and, in turn, trolling motor 108, returns to the fixed position. This action prevents craft 100 from making too sharp of a turn and the user from losing control. It also brings trolling motor 108 back to a "known" position. If the user commands trolling motor 108 to move forward, then the user knows craft 100 will move forward along directional axis A and not run the rear of craft 100 up on a beach or the like.

As shown by FIGS. 3(*a*)-(*c*), the user of craft 100 does not need poles or additional trolling motors to navigate narrow or shallow water ways. Using control 114, the user can turn motor 202 to a specified angle without the need for constantly looking back or checking the angle visually. Further, once the user releases control of turning motor 202, steering system 110 brings motor 202 back to the fixed position to prevent accidents or errors. Craft 100, therefore, moves straight ahead or backwards when instructed.

Although disclosed above with regard to water-borne craft, the disclosed embodiments of the present invention is applicable to any craft having two separate propulsion motors, such as power motor 106 and trolling motor 108 shown in FIG. 1. Motors that move a craft, boat, and the like within a medium, such as water, air and the like, use the present invention to orient and move in a more controlled manner. For example, a very light craft moving in air may use a primary motor and a secondary motor in maneuvering. The secondary motor is turned using the disclosed embodiments to orient the light craft as needed in the air, possibly to dock with another craft.

Figure 4:
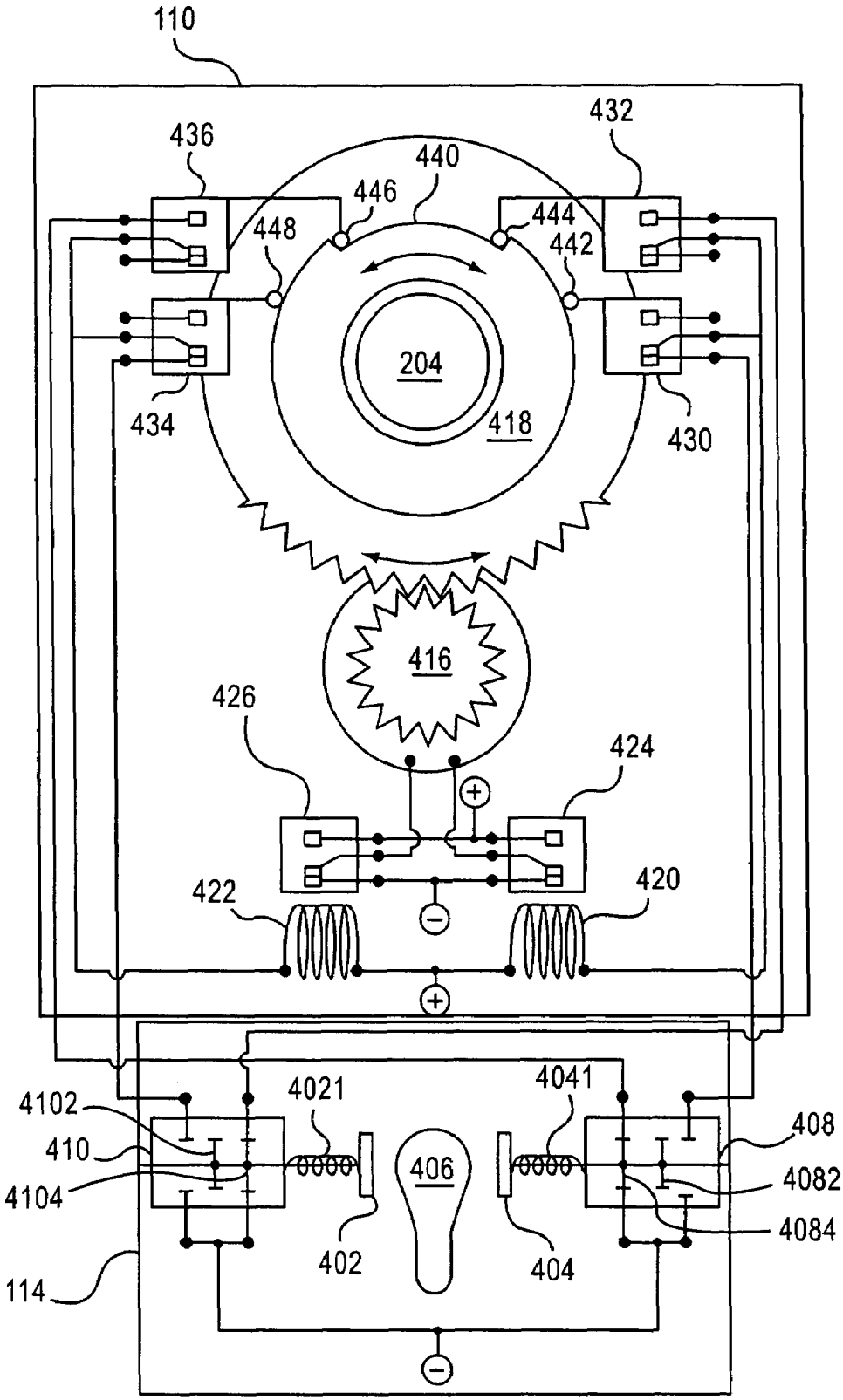
FIG. 4 illustrates a schematic diagram of a control and a steering system for a fixed orientation according to the disclosed embodiments.

FIG. 4 depicts a schematic diagram of control 114 and steering system 110 for trolling motor 108 that maintains a fixed, or linear, orientation. The fixed position is shown in FIG. 3(*a*) disclosed above. In this position, craft 100 will move forward without the need for the user to look back to ensure trolling motor 108 is in the right position and orientation. The user does not desire to make a sharp turn that disturbs the forward position of craft 100.

Control 114 receives input from the user. The user may use footpads, remote controls, and the like. Preferably, the user places a foot 406 in the middle of a pad for control 114 and uses the leg of foot 406 to press bumpers 402 and 404. Because of the fixed, straight ahead orientation, the leg of foot 406 should not touch bumpers 402 and 404. As disclosed below, bumper 402 is pressed by the leg for a left turn and bumper 404 is pressed for a right turn. If the user desires not turning, then he/she should avoid contact with bumpers 402 and 404.

Bumpers 402 and 404 activate spring loaded switches 410 and 408, respectively. Bumper 402 presses spring 4021 and bumper 404 presses spring 4041 to activate switches 410 and 408. When pressed hard enough, contacts within switches 410 and 408 move to complete circuits to enable left or right turns. According to FIG. 4, contact 4104 of switch 410 completes a circuit to steering motor system 110 for a straight ahead orientation. Contact 4084 acts in the same manner.

Steering system 110 includes components that activate steering motor 416 to turn cam 418, which turns shaft 204. As shown in FIG. 4, steering motor 416 and cam 418 engage each other using grooves. As steering motor 416 turns, so does cam 418. Cam 418 is attached to shaft 204. Cam 418 is a circular part attached to shaft 204 that turns it in response to being engaged by steering motor 416. Shaft 204 may turn the appropriate components of trolling motor 108 to a desired position. Switches 426 and 424 activate motor 416 to turn in a right or left direction depending on the desired orientation or turning direction for craft 100.

Magnetic relays 420 and 422 activate switches 424 and 426, respectively. As current flows through relay 420 or 422, the generated magnetic field turns the respective switch 424 or 426 into the "on" position. Preferably, relays 420 and 422 generate a field of 12 volts when connected to the respective circuit in steering assembly 110. The "on" switch activates steering motor 416 to turn towards the desired direction. This process is disclosed in greater detail below. With regard to the steering motor switches, switches 424 and 426 preferably are snap switches. As shown in FIG. 4, switches 424 and 426 are "off" such that steering motor 416 is not turning cam 418.

Cam 418 also includes indent 440 that indicates when cam 418, and, in turn, shaft 204, reaches a specified angle. The specified angle is the maximum value for the angle between the fixed position of trolling motor 108 and the turn position when steering motor 416 rotates cam 418 and shaft 204. For example, the user sets the maximum value for the angle between the fixed position and a position of trolling motor 108 when turning left or right at 45 degrees. Steering motor 416 will rotate cam 418 up to 45 degrees. Indent 440 allows steering assembly 110 to determine when to stop turning cam 418.

Indent 440 works in conjunction with switches 430, 432, 434 and 436 that connect to rollers 442, 444, 446 and 448, respectively. Preferably, the switches are connected to the rollers with spring arms to allow the rollers to move along cam 418 and into indent 440 in a smooth manner. Further, switches 430-436 preferably are snap switches. For the fixed position, switches 430-436 are "off."

Rollers 442, 444, 446 and 448 also may be referred to as sensors because the change in position of the rollers is "sensed" as it rolls into indent 440. Other sensors, such as optical sensors, may be used according to the disclosed embodiments. Any component or configuration that detects when indent 440 or another marker reaches the maximum angle value can be used within steering assembly 110.

Thus, according to the schematic shown in FIG. 4, craft 100 may stay in a fixed linear orientation without trolling motor 108 moving inadvertently to cause craft 100 to wander around as it moves forward or backward. Using cam 418 and indent 440, steering assembly 110 keeps shaft 204 fixed to eliminate any uncertainty of the direction craft 100 is moving. If the user is not pressing bumper 402 or 404, then he/she knows shaft 204 and trolling motor 108 is set in the fixed position. The user does not need to check before every instant that craft 100 moves.

Figure 5:
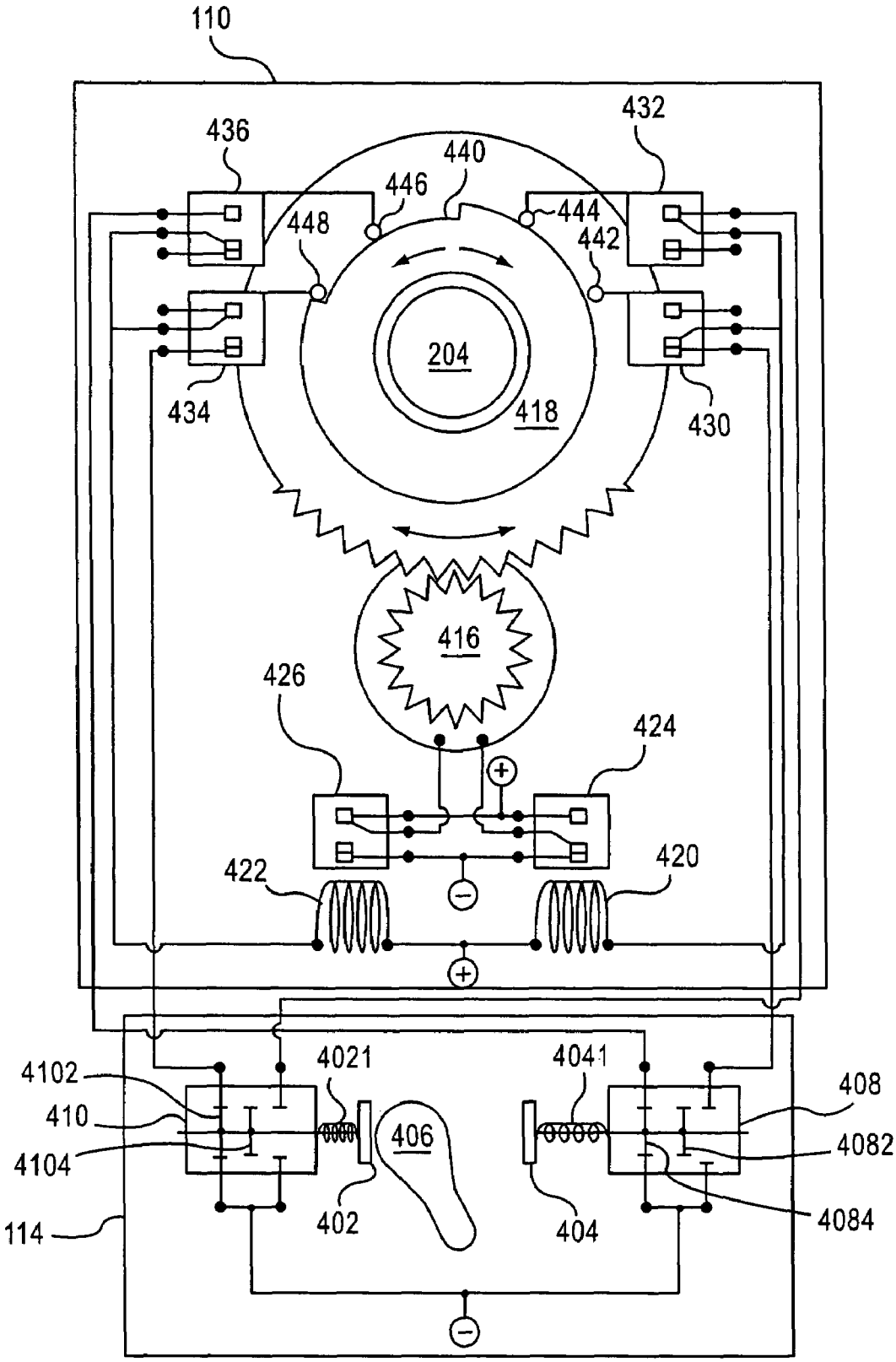
FIG. 5 illustrates a schematic diagram for a control and a steering motor for turning the craft towards the left according to the disclosed embodiments.

FIG. 5 depicts a schematic diagram of control 114 and steering system 110 for trolling motor 108 for turning craft 100 towards the left according to the disclosed embodiments. Referring back to FIG. 3(*b*) disclosed above, craft 100 begins to move left as motor 202 of trolling motor 108 turns. Steering system 110 turns shaft 204 to the desired orientation for making the left turn.

The user presses his/her leg against bumper 402. The placement of a user's foot during this pressing action is represented by 406 in FIG. 4. Bumper 402 presses spring 4021 to move contact 4104 out of its circuit and contact 4102 to connect with its circuit. As shown in FIG. 5, contact 4102 couples to switch 434. Switch 434 turns "on" to begin sensing with roller 448. Further, magnetic relay 422 turns on switch 426 to move steering motor 416 in the desired direction. As steering motor 416 turns, cam 418 moves indent 440 towards roller 448. Switch 436 is not in the "on" position.

Switch 424 stays in an "off" position, along with switch 430. Switch 432, however, moves to the "on" position as indent 440 moves away from it. Roller 444 moves out of the indent, but is sensing the position of the indent to determine when indent 440 moves away from turning to return back to the fixed position. Steering system 108 includes this double check feature to ensure cam 418 does not move inadvertently.

Figure 6:
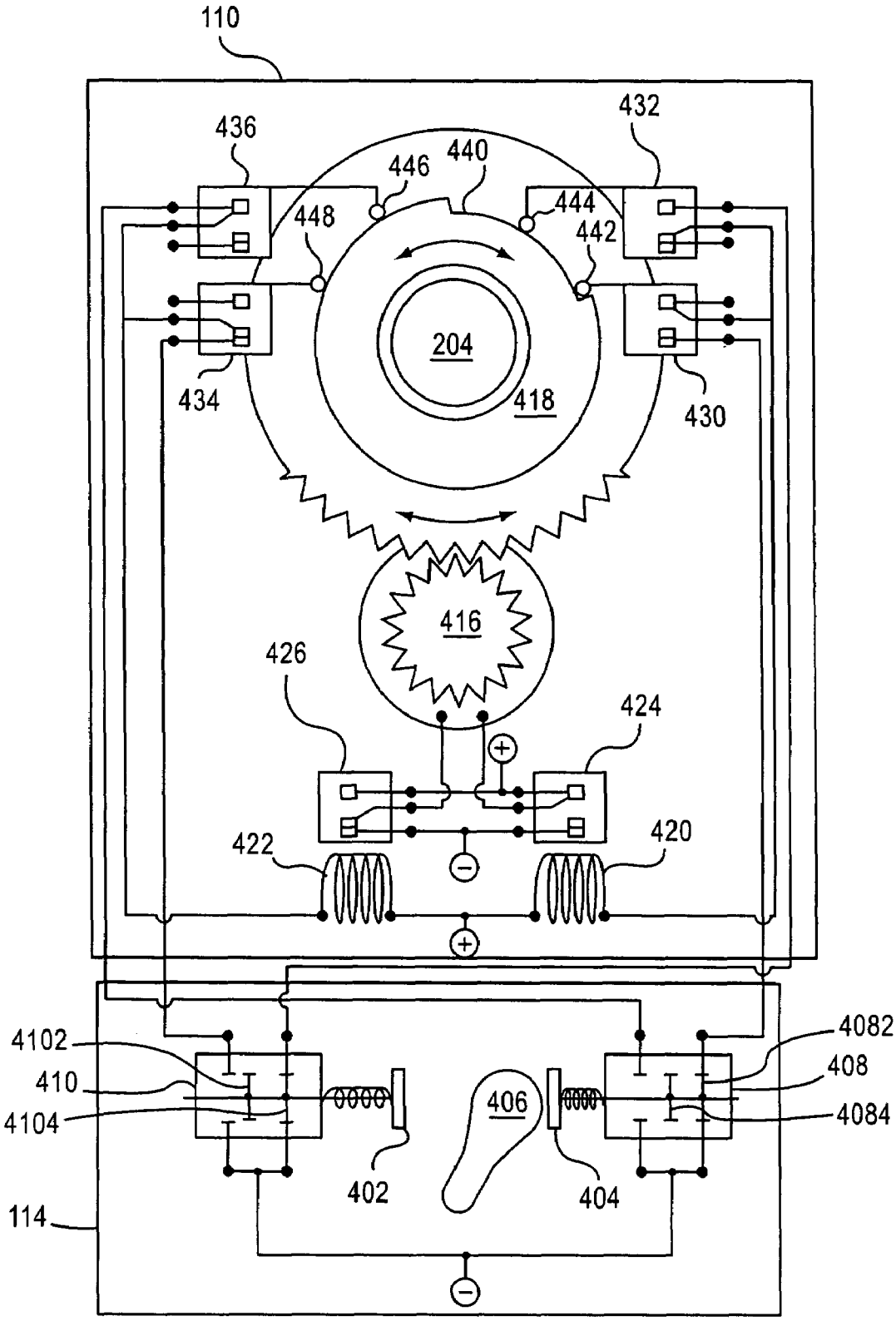
FIG. 6 illustrates a schematic diagram for a control and a steering motor for turning the craft towards the right according to the disclosed embodiments.

FIG. 6 depicts a schematic diagram of control 114 and steering system 110 for trolling motor 108 to turn craft 100 towards the right according to the disclosed embodiments. Referring back to FIG. 3(*c*) disclosed above, craft 100 begins to move right as motor 202 of trolling motor 108 turns. Steering system 110 turns shaft 204 to the desired orientation for making the right turn.

The user presses his/her leg of foot 406 against bumper 404 to move contacts 4082 and 4084. Contact 4084 disengages from its circuit while contact 4082 moves to connect to switch 430. Magnetic relay 420 comes on to generate a field that activates switch 424 to the "on" position. Switch 426 remains in the "off" position. Steering motor 416 rotates cam 418 and shaft 204 in response to switch 424. As cam 418 turns, indent 440 moves towards roller 442.

Switch 430 snaps to the "on" position so that roller 442 acts as a sensor to indicate when indent 440 rotates as far as it can go. Further, switch 436 comes "on" to use roller 446 as a sensor to indicate when indent 440 rotates back to the fixed position. Switches 432 and 434 are preferably "off" during a right turn of craft 100.

Thus, as shown in FIGS. 4, 5 and 6, steering system 110 orients trolling motor 108 by rotating shaft 204 in accordance with a steering motor 416 and cam 418. In an embodiment, once indent 440 reaches either roller 448 or 442, cam 418 automatically rotates back to the fixed, or linear, position shown in FIG. 4. This feature may prevent excessive turns when something presses bumper 402 or 404. Alternatively, the user may hold indent 440 in its left or right position until pressure is taken off bumper 402 or 404.

Further, rollers 442-448 can be positioned anyplace along cam 418. Rollers 442-448 are moved to adjust the maximum turn angle allowed by steering assembly 110. In other words, if rollers 448 and 442 are placed farther away from rollers 446 and 444, respectively, then cam 418 may rotate further in orienting trolling motor 108. Moreover, indent 440 and cam 418 can be adjusted or resized to vary the angle.

Therefore, the disclosed embodiments of the present invention provides a steering system and method for turning a craft or going straight without a user looking back at the motor position. Steering of the craft occurs without looking at the orientation or position of the trolling motor. The disclosed embodiments also are applicable to other motors besides trolling motors, and serves to orient the motor in an efficient and safe manner.

The user can steer the craft to any orientation without first hand knowledge where the motor is positioned. Essentially, the motor is in one of three positions. The first position is the fixed, or linear, position that may allow the craft to go straight forward or backward. The other two positions related to the maximum angle allowed from the fixed position to a point left or right of the fixed position. Once in this position, the user can move the craft forward or backward to re-orient the craft. Depending on the command given to the control unit of the steering assembly, the user knows what position the motor is in. For example, if the user is not pressing a bumper or giving an instruction to turn, the user knows that the motor is in the fixed position.

As disclosed above, a steering system is provided to direct the orientation of a motor, such as an electric trolling motor, from one fixed position to a secondary fixed position to complete the act of steering for positioning of the craft. Preferably, the craft is a boat. The positioning is accomplished by having the motor in a fixed position that propels the craft in a straight-ahead orientation to move forward or backward without turning.

Steering is now achieved by repositioning the motor to other fixed positions to the right or left. The right or left fixed positions may be at an angle from the fixed position. The angle may have a value between 15 and 90 degrees, with a preferred value of 45 degrees. The right or left fixed position of the motor then positions the craft to a right or left turn.

Upon completion of the positioning of the craft, the motor is automatically repositioned back to the fixed position. Thus, in the example above, the trolling motor returns back to the fixed position to allow the boat to move straight forward or backward. If the user keeps the trolling motor in the right or left fixed position, then the boat may move in the appropriate direction for turning or positioning.

It will be apparent to those skilled in the art that various modifications and variations can be made in the disclosed embodiments of the present invention without departing from the spirit or scope of the invention. Thus, it is intended that the present invention covers the modifications and variations of the embodiments disclosed above provided that they come within the scope of any claims and their equivalents.

What is claimed is:

1. A steering system for turning a craft and automatically reorienting the craft in a straight ahead direction comprising:

a trolling motor having a motor shaft;

a steering motor linked to the shaft for rotating the motor shaft;

a cam mounted to the motor shaft, the cam having an indent along a portion of a peripheral surface thereof, a pair of first and second switches, activation of the first switch causing the steering motor to rotate the motor shaft in a first direction, activation of the second switch causing the steering motor to rotate the motor shaft in a second direction, a pair of first pressure loaded stop switches, one pressure loaded switch arranged with respect to the cam to stop rotation of the steering motor in the first direction once the cam reaches a first stop position, the other pressure loaded switch arranged with respect to the cam to stop rotation of the steering motor in the second direction once the cam reaches a second stop position, and a pair of second pressure loaded stop switches, each arranged with respect to the cam with a sensor, engagement of each sensor in the indent defining the straight direction of travel for the craft when the trolling motor is in operation, wherein deactivation of either of the first or second switches activates one of the second pressure loaded stop switches to reverse rotation of the steering motor, the reverse rotation of the steering motor stopping when the sensors of second pressure loaded stop switches engage the indent.

2. The system of claim 1, wherein each of the second pair of pressure loaded stop switches is positioned with respect to the cam to limit the rotation of the motor shaft between 15 and 90 degrees.

3. The system of claim 1, wherein the first and second switches are spring loaded switches, wherein operation of each switch occurs by pressing on the switch and the switch ceases to operate when pressing is stopped.

4. The system of claim 1, wherein the first and second switches are operated using remote control.

5. In a craft having a trolling motor that includes a motor shaft and a steering motor to rotate the motor shaft control movement of the craft, the improvement comprising the system of claim 1 linked to the motor shaft for operating the steering motor.

6. The craft of claim 3, wherein the first and second switches are in an elevated position on the craft so that they can be operated by a leg of a user of the system.

7. The craft of claim 3, wherein the first and second switches are spring loaded switches, wherein activation of each switch occurs by pressing on the switch and the switch ceases is deactivated when pressing is stopped.

8. The craft of claim 7, wherein the first and second spring loaded switches are in an elevated positioned on the craft so that they can be activated by a leg of a user of the system.

* * * * *